US009061487B2

(12) United States Patent
Greive et al.

(10) Patent No.: US 9,061,487 B2
(45) Date of Patent: Jun. 23, 2015

(54) METHOD FOR CHANGING PRINTING PLATES IN ROTARY PRINTING PRESSES HAVING A PLURALITY OF PRINTING UNITS, PRINTING PRESS AND CONTROLLER

(75) Inventors: Martin Greive, Schriesheim (DE); Alexander Knabe, Heidelberg (DE); Jochen Körner, Viernheim (DE); Jan Teubert, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1028 days.

(21) Appl. No.: 13/053,699

(22) Filed: Mar. 22, 2011

(65) Prior Publication Data

US 2011/0226146 A1 Sep. 22, 2011

(30) Foreign Application Priority Data

Mar. 22, 2010 (DE) ..... 10 2010 012 280

(51) Int. Cl.
*B41F 27/12* (2006.01)
*B41F 33/16* (2006.01)
(Continued)

(52) U.S. Cl.
CPC ..... *B41F 27/1206* (2013.01); *B41F 13/24* (2013.01); *B41F 33/12* (2013.01); *B41F 33/14* (2013.01); *B41P 2227/62* (2013.01); *B41P 2227/63* (2013.01)

(58) Field of Classification Search
CPC .... B41F 13/008; B41F 13/24; B41F 27/1206; Y10S 101/36; B41P 2227/62; B41P 2227/63
USPC ..... 101/216, 218, 247, 248, 477, 479, 480, 101/484
See application file for complete search history.

(56) References Cited

U.S. PATENT DOCUMENTS 5,937,149 A 8/1999 Lindner et al.
5,983,793 A 11/1999 Volz et al.
(Continued)

FOREIGN PATENT DOCUMENTS

DE 196 36 703 A1 3/1998
DE 10 2008 030 438 A1 1/2009
(Continued)

OTHER PUBLICATIONS

German Patent and Trademark Office Search Report, Dated Dec. 27, 2010.
(Continued)

*Primary Examiner* — Blake A Tankersley
*Assistant Examiner* — Marissa Ferguson Samreth
(74) *Attorney, Agent, or Firm* — Laurence A. Greenberg; Werner H. Stemer; Ralph E. Locher

(57) ABSTRACT

A method for changing printing plates in rotary printing presses, including a plurality of printing units each having a plate cylinder and a dedicated drive for driving the plate cylinder independently of an associated blanket cylinder in a respective printing unit, includes moving the respective blanket cylinder at a somewhat higher circumferential speed than the associated plate cylinder while conveying one or more printing plates out of the printing unit, at least in one operating mode, during a plate changing operation. A printing press and a controller are also provided.

16 Claims, 4 Drawing Sheets

(51) Int. Cl.

| | |
|---|---|
| ***B41F 13/24*** | (2006.01) |
| ***B41F 33/12*** | (2006.01) |
| ***B41F 33/14*** | (2006.01) |

(56) References Cited

U.S. PATENT DOCUMENTS

| | | | | |
|---|---|---|---|---|
| 6,125,757 | A * | 10/2000 | Lemelin | 101/477 |
| 6,814,003 | B2 | 11/2004 | Tobe et al. | |
| 6,823,785 | B2 | 11/2004 | Schneider et al. | |
| 6,895,857 | B2 | 5/2005 | Weschenfelder | |
| 2008/0000376 | A1 | 1/2008 | Wiese et al. | |
| 2009/0013889 | A1 | 1/2009 | Gorbing et al. | |

FOREIGN PATENT DOCUMENTS

| | | | |
|---|---|---|---|
| DE | 100 66 095 | B4 | 11/2009 |
| EP | 0 834 398 | B1 | 4/1998 |
| EP | 1 348 551 | B1 | 10/2003 |
| EP | 2036726 | A2 | 3/2009 |
| JP | 2004508983 | A | 3/2004 |
| JP | 2004508984 | A | 3/2004 |
| WO | 0224454 | A1 | 3/2002 |
| WO | 2006/018105 | A2 | 2/2006 |

OTHER PUBLICATIONS

European Search Report dated Apr. 28, 2011.

* cited by examiner

METHOD FOR CHANGING PRINTING PLATES IN ROTARY PRINTING PRESSES HAVING A PLURALITY OF PRINTING UNITS, PRINTING PRESS AND CONTROLLER

CROSS-REFERENCE TO RELATED APPLICATION

This application claims the priority, under 35 U.S.C. §119, of German Patent Application DE 10 2010 012 280.7, filed Mar. 22, 2010; the prior application is herewith incorporated by reference in its entirety.

BACKGROUND OF THE INVENTION

Field of the Invention

The present invention relates to a method for changing printing plates in rotary printing presses having a plurality of printing units. The printing presses can be sheet-fed or web-fed rotary presses. The invention also relates to a printing press having a plurality of printing units and a controller for rotary printing presses.

A whole range of different fully automatic and semiautomatic methods are already known for changing the printing plates of offset printing presses. In printing presses in which both the plate cylinders and the blanket cylinders of the printing units are always connected by gearing to a main drive of the printing press, the plates are conveyed successively one after another out of the printing unit after the opening of clamping rails due to different phase positions of the plate cylinders relative to the machine angle in the individual printing units, are removed after being conveyed out, and new plates are successively conveyed into the printing units again. In recent years, however, printing presses have also become known in which the plate cylinders have dedicated drives, with which they can be rotated independently of the machine drive and therefore also relative to the blanket cylinder, optionally during changeover or set up operations on the machines, after the respective plate cylinder has been decoupled from the main drive of the machine by a clutch.

A printing press of that type is described, for example, in German Published Patent Application DE 10 2008 030 438 A1, corresponding to U.S. Patent Application Publication No. US 2009/0013889 A1. During the plate change, although the plates therein are conveyed one after another out of the printing units by the main drive in the coupled state of the plate cylinders, the plate cylinders are subsequently thrown off the blanket cylinders and are decoupled from the main drive of the machine. The intake of the new plates then takes place in such a way that the plate cylinders draw in all of the printing plates at the same time by way of their auxiliary drive. In addition, it is also known, for example, from International Publication No. WO 2006/018105 A2, corresponding to U.S. Patent Application Publication No. US 2008/0000376 A1, to perform the entire plate changing operation, that is to say the conveying of the printing plates out and in again, solely by way of the drives of the plate cylinders, while the blanket cylinder in the respective printing unit, which is moved otherwise at the same time by the machine drive, is subjected, for example, to a washing operation.

Disruptions can then occur during a plate changing operation as a result of the fact that, for example, the printing plate tilts in a printing unit while being conveyed out, the electromechanically actuated clamping rail does not open, the sensors for detecting the plate edge or the plate end report faults, etc. Operating modes have therefore also already been developed, in order to terminate the plate changing operation as effectively as possible in time terms in the case of a disruption of that type. To that end, European Patent EP 1 348 551 B1, corresponding to U.S. Pat. No. 6,814,003, proposes, after detection of the disruption, first of all decoupling the plate cylinder in the disrupted printing unit from the drive and completely terminating the changing operation for the remaining printing units before the disruption is then eliminated, after which the plate in the disrupted printing unit is changed.

As can be readily seen, the overall time requirement for that method is not minimal, since the plate change is carried out separately for the disrupted printing unit and also does not coincide partly with the changing operation for the remaining printing units which are not disrupted. However, it is already known, for example, from German Published Patent Application DE 196 36 703 A1, corresponding to U.S. Pat. No. 5,937,149, to stop the drives of all of the printing units if a disruption occurs during the plate changing operation, to eliminate the disruption and subsequently to allow the changing operation to continue for all of the printing units (German Published Patent Application DE 196 36 703 A1, corresponding to U.S. Pat. No. 5,937,149). That is not always possible, however, in many cases, dependent on the type of disruption. It can thus be necessary first of all to rotate the plate cylinder in the disrupted printing unit into a defined position, for example for it to be possible to release the clamping rails by hand and later to rotate the plate cylinder into a defined reference position or to rotate it back again in order to eject the plate. If the cylinders in the other printing units then also run, while the clamping rails are already released there, the printing plates in those units can be jolted/clamped etc. as a result of the optionally repeated forward and backward running in the printing units.

Problems occur even when the decoupled plate cylinder with the plate situated on it is rotated backward for the purpose of being conveyed out of the printing unit, while the plate cylinder which is coupled, for example, by gearing to the main drive of the machine is at a standstill or performs an opposite movement. That is because if the plate which is released from the clamping rail comes into contact with the blanket cylinder while being conveyed out, due to the small spacing from the blanket cylinder, the plate can be deflected and can then miss the path back into the removal position at the cover of the printing unit with greater or lesser probability, dependent on the spatial conditions in the printing unit, the presence of special guides, etc., and can possibly be bent, etc. in the process.

SUMMARY OF THE INVENTION

It is accordingly an object of the invention to provide a method for changing printing plates in rotary printing presses having a plurality of printing units, a printing press and a controller, which overcome the hereinafore-mentioned disadvantages of the heretofore-known methods and devices of this general type, in which the removal of the plates takes place as reliably as possible in operating modes and in which the conveying of the plates out of the printing unit is carried out by a separately driven, decoupled plate cylinder, that is to say in the case of a disruption, for example.

With the foregoing and other objects in view there is provided, in accordance with the invention, a method for changing printing plates in rotary printing presses having a plurality of printing units. The method comprises providing each printing unit with a blanket cylinder, a plate cylinder associated with the blanket cylinder, and a dedicated drive for driving the plate cylinder independently of the associated blanket cylinder. During a plate changing operation, at least in one operating mode, a respective blanket cylinder is moved at a somewhat higher circumferential speed than an associated plate cylinder, while conveying one or more printing plates out of the printing unit by the decoupled plate cylinder.

As a result, the printing plate is not compressed when it comes into contact with the blanket cylinder during the ejection movement, but rather is "pulled straight" at most by the somewhat higher circumferential speed of the rubber blanket. In this way, it always finds its way reliably back into the holding position on the cover of the printing unit. If then, for example, in the mode for eliminating a disruption of the plate cylinders in the disrupted printing unit, the plate is therefore conveyed out of the printing unit after the elimination of the disruption, after the plate change for the printing units which are not disrupted is already completely terminated and there would be no necessity to move the machine drive with all of the blanket cylinders which are driven by it, nevertheless the machine drive would expediently be switched on at the same time in accordance with the method according to the invention, in order to allow the blanket cylinder to rotate at a slightly higher circumferential speed tangentially in the same direction, in which the plate is conveyed away. The same measure can expediently of course also be taken if, before or after the elimination of the disruption, the plate cylinders move out the printing plates in the printing units which are not disrupted or are not disrupted any more, and in the case of plate changing methods, in which the conveying out is always carried out by the plate cylinder in the state in which it is thrown off and decoupled from the main drive of the machine.

The method according to the invention for changing printing plates is particularly fast even in the case of disruptions if, during the occurrence of a disruption in a printing unit, the plate cylinders in the printing units which are not disrupted are decoupled, with the respective blanket cylinders in the printing units being moved at a somewhat higher speed than the plate cylinders, while the latter continue the ejection operation and at the same time, the plate cylinder of the disrupted printing unit is also decoupled and the plate cylinder is moved there into the position in which the disruption can be eliminated, for example the position in which the screws of the plate clamping rail can be opened manually, or the plate cylinder of the disrupted printing unit moves into a reference position. It is generally advantageous if the disruption is eliminated before new printing plates are clamped in the printing units which are not disrupted. In this case, the plates can namely be pulled in at the same time and synchronously in all of the printing units of the machine after the ejection of the plate in the disrupted printing unit.

Other features which are considered as characteristic for the invention are set forth in the appended claims.

Although the invention is illustrated and described herein as embodied in a method for changing printing plates in rotary printing presses having a plurality of printing units, a printing press and a controller, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
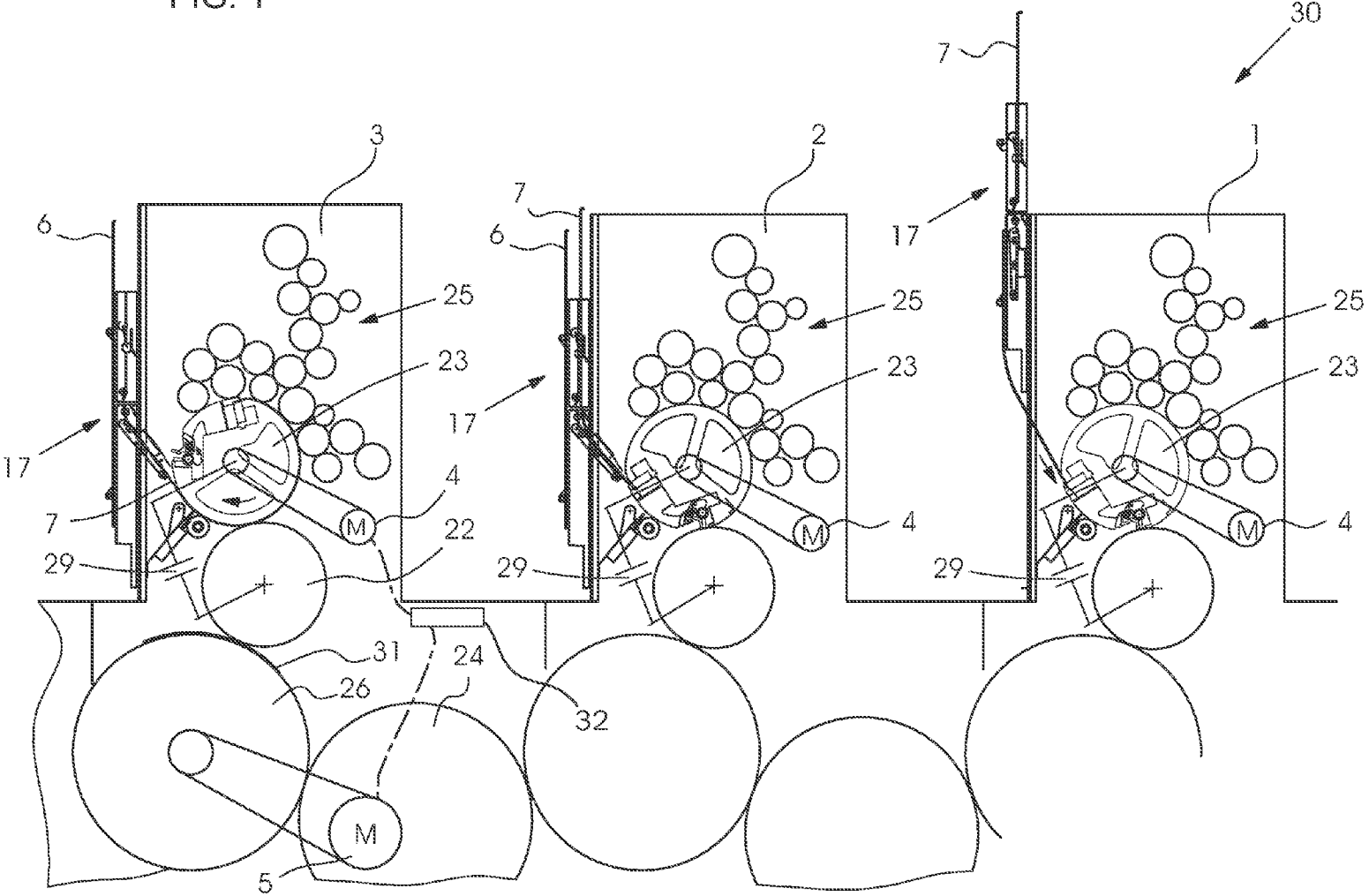
FIG. 1 is a fragmentary, diagrammatic, longitudinal-sectional view of a sheet-fed offset rotary printing press having a plurality of inline printing units.

Referring now to the figures of the drawings in detail and first, particularly, to FIG. 1 thereof, there is seen a sheet-fed offset rotary printing press 30 having a plurality of printing units of inline construction, of which three printing units 1, 2, 3 are shown. Each of the printing units 1, 2, 3 has an inking unit 25 which transfers printing ink onto a printing plate, which has a printing image and is clamped onto a plate cylinder 23 during printing operation. The printing image is transferred from the printing plate on the plate cylinder 23 onto a blanket cylinder 22 and onto printing material 31 which is printed in a press nip between the blanket cylinder 22 and an impression cylinder 26. The printing materials 31 are moved between the printing units 1, 2, 3 through the use of transport cylinders 24. The impression cylinders 26, the transport cylinders 24 and the blanket cylinders 22 are fixedly connected mechanically to one another through a gearwheel train and are driven by a main drive motor 5. During printing operation, the plate cylinders 23 in the printing units 1, 2, 3 are also driven by the gearwheel train, through clutches 29 which are illustrated diagrammatically herein and are closed or connected between the plate cylinders 23 and the blanket cylinders 22.

If a print job change is imminent, new printing plates 6 with new color separations have to be pulled onto the plate cylinders 23 and old printing plates 7 have to be removed. To this end, the printing units 1, 2, 3 have a plate changer 17 on the left hand side in each case. The plate changer 17 receives the old printing plate 7 and provides the new printing plate 6. Moreover, during a printing plate change, the plate cylinders 23 can be decoupled and can be driven independently of the other cylinders 22, 24, 26 through the use of a dedicated drive motor (auxiliary drive) 4. The main drive motor 5 and the separate drive motors 4 of the auxiliary drives are controlled by a machine controller 32 with a corresponding control computer.

In FIG. 1, the three printing units 1, 2, 3 are situated in different positions during the plate change. In the printing unit 3, the rear plate edge of the old printing plate 7 has just been released, with the result that the old printing plate 7 can be conveyed out. In the printing unit 2, the old printing plate 7 has been pushed out into the plate changer 17 by the plate cylinder 23 which is running backward. In the printing unit 1, the old printing plate 7 has been pushed completely out of the printing unit 1 and into a position in the plate changer 17. The new plate can be clamped in that position.

Figure 2:
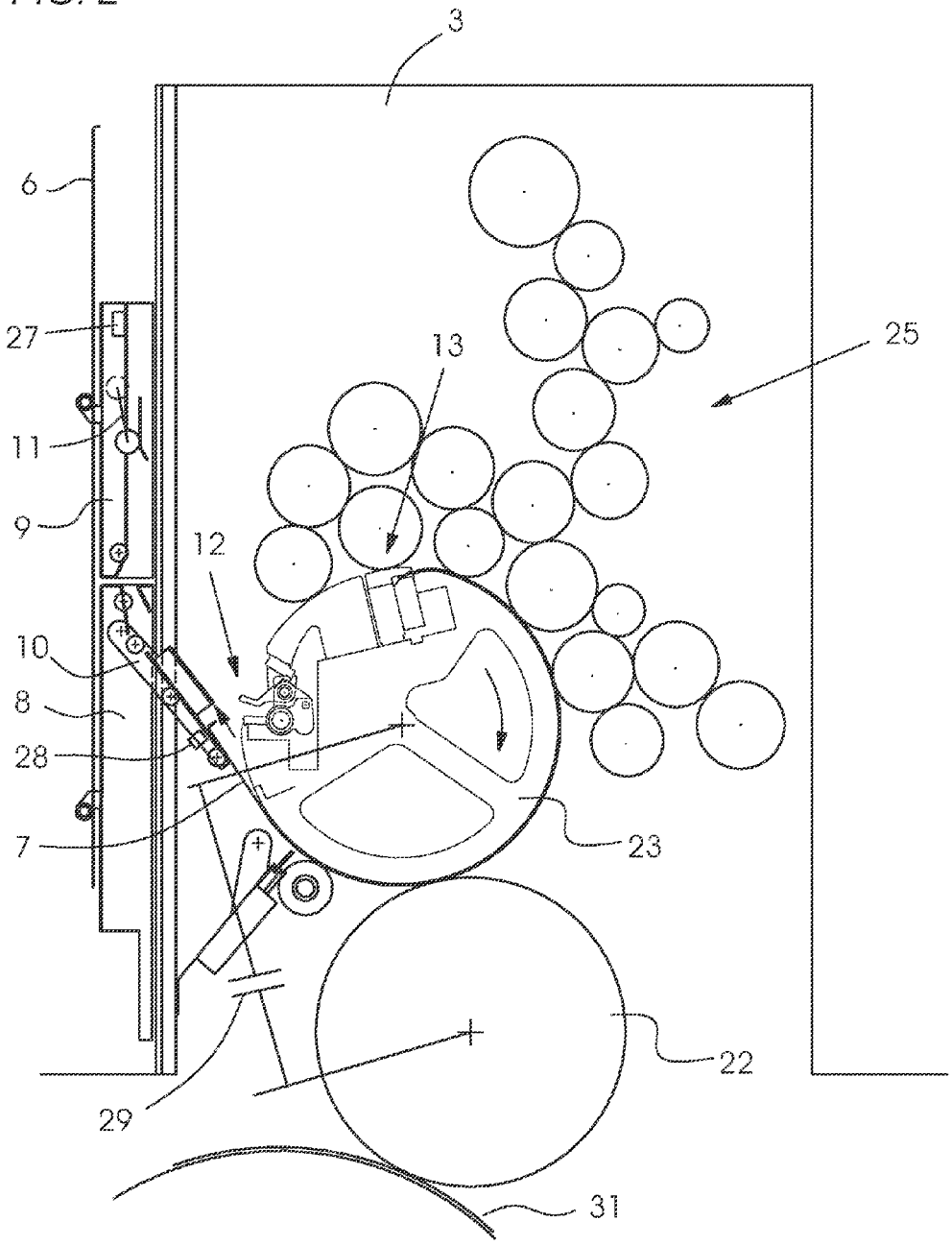
FIG. 2 is an enlarged, sectional view of one printing unit of the printing press shown in FIG. 1.

FIG. 2 shows the printing unit 3 in greater detail. It can be seen therein that the plate changer 17 has a lower plate guiding element 8 and an upper plate guiding element 9. A pivotable guide element 10 is situated in the lower plate guiding element 8. The guide element 10 is provided for guiding the old printing plate 7 away from the plate cylinder 23 over rollers. The plate changer 17 itself is mounted mechanically in such a way that it can be raised up easily and lowered again by an operating staff, assisted by gas pressure springs or other aids. Moreover, the plate changer 17 carries a sensor 27, by way of which the correct removal of the old plate 7 can be determined. Guiding elements with rollers are situated on the outer side of the plate changer 17. The new printing plate 6 is mounted, ready to be received, in the guiding elements. In order to remove the old printing plate 7, the guiding element 10 is pivoted toward the plate cylinder 23, as a result of which the old printing plate 7 can slide out on the rollers of the guiding element 10. In order to convey out the old printing plate 7, a plate clamping device 12 for a rear plate edge on the plate cylinder 23 is opened, as a result of which the old printing plate 7 is detached from the plate cylinder 23 as a consequence of the rigidity of the old printing plate 7, and can slide out on the rollers of the pivotable guiding element 10. The conveying out of the old printing plate 7 normally takes places with the blanket cylinder 22 thrown onto the plate cylinder 23, as a result of which the old printing plate 7 is conveyed in the direction of the pivotable guiding element 10 in the nip between the blanket cylinder 22 and the plate cylinder 23. A further sensor 28 is attached on the pivotable guiding element 10. Through the use of this plate sensor 28, the machine controller 32 is informed as to whether or not the old printing plate 7 has actually been detached from the plate cylinder 23 and is not tilted for any reason. During the disruption-free conveying out of the old printing plate 7, the blanket cylinder 22 and plate cylinder 23 are coupled mechanically to one another and are driven by the continuous gear train through the main drive motor 5. In the process, the plate cylinder 23 moves in the direction of the arrow, as a result of which the old printing plate 7 is conveyed into the plate changer 17.

Figure 3:
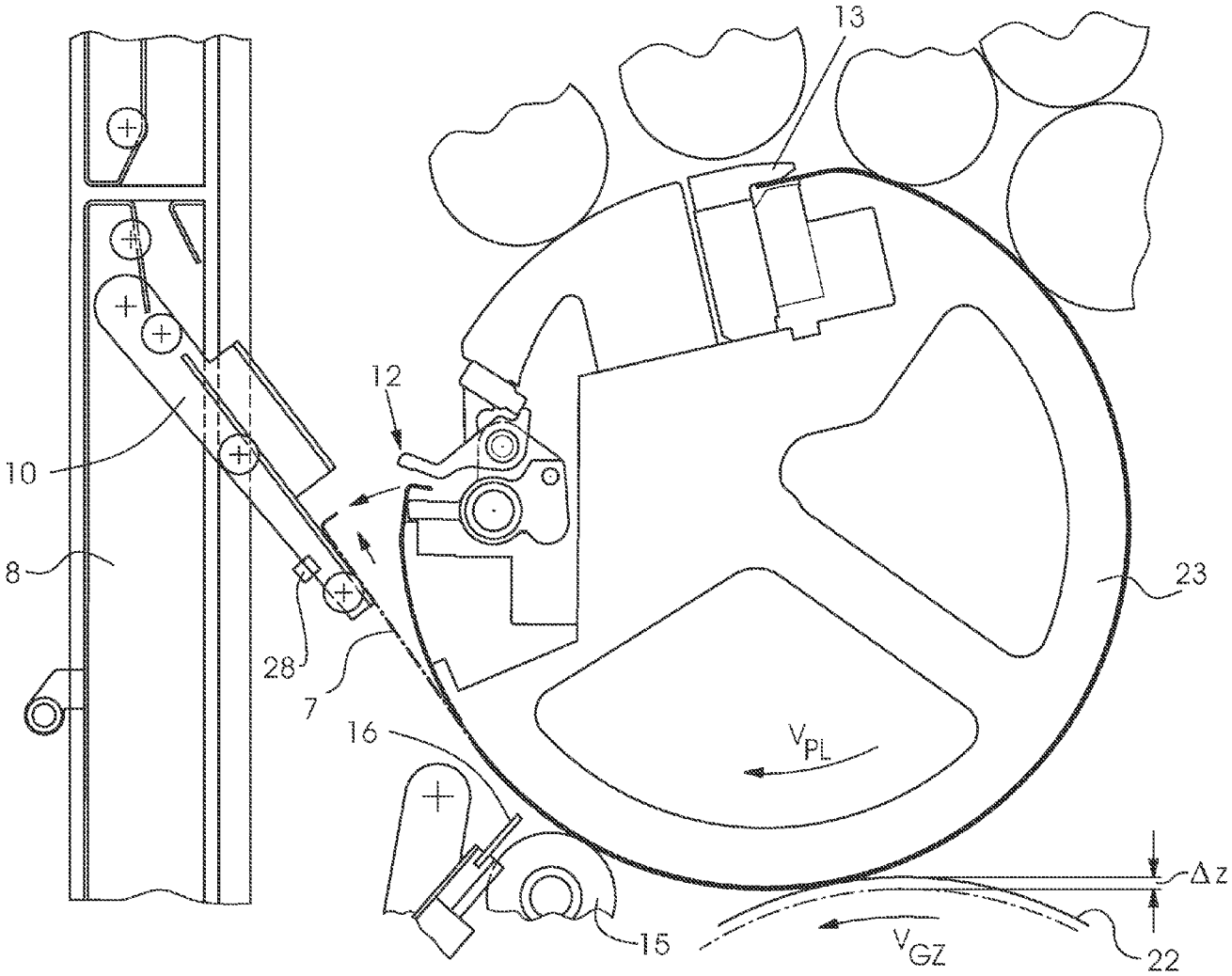
FIG. 3 is a further enlarged, sectional view of a plate cylinder region of the printing unit shown in FIG. 2.

The illustration in FIG. 3 shows an enlargement of the region around the plate cylinder 23 in the printing unit 3. In FIG. 3, the open plate clamping device 12 for the rear plate edge can be seen, which makes it possible to convey out the old printing plate 7. In contrast, a plate clamping device 13 for the front plate edge on the plate cylinder 23 remains closed until the old printing plate 7 has passed the nip between the blanket cylinder 22 and the plate cylinder 23. Moreover, a pressure element 16 can be seen in FIG. 3, which will be required later when the new printing plate 6 is clamped in.

Figure 4:
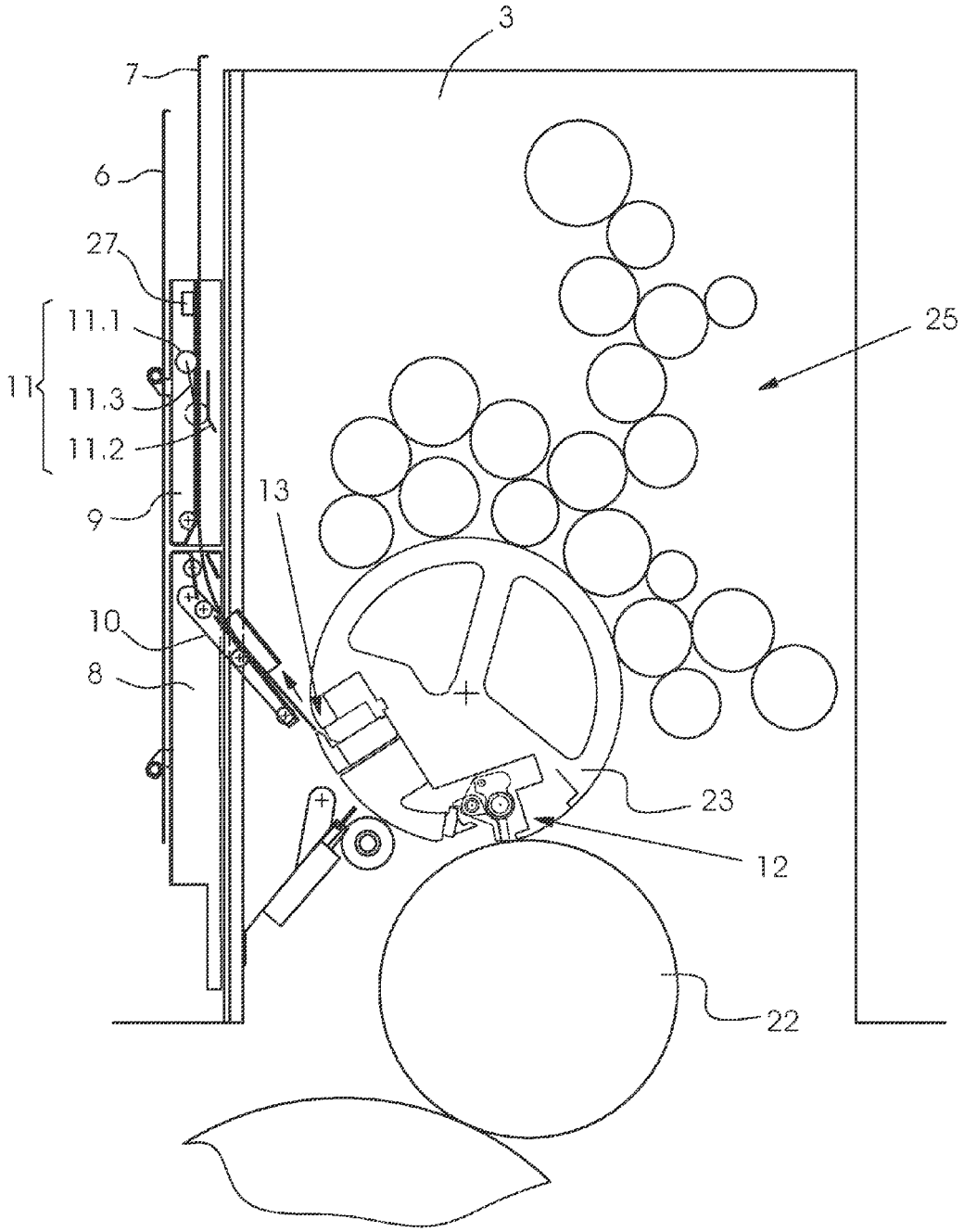
FIG. 4 is a view similar to FIG. 2 of the printing unit after a printing plate has been conveyed out of the plate cylinder.

In FIG. 4, the old printing plate 7 has been conveyed out of the plate cylinder 23, as a result of which only the plate clamping device 13 for the front edge still has to be opened. This end position of the old printing plate 7, which has been pushed out, can also be determined by the sensor 27. At the latest when this end position is reached, the control computer opens the mechanical clutch 29 between the plate cylinder 23 and the blanket cylinder 22 and decouples the two cylinders from one another. As an alternative, the clutch 29 can also already be opened when the clamping device 12 has passed the blanket cylinder 22. From this instant on, the plate cylinder 23 is driven only through its associated separate drive motor 4. The plate cylinder 23 can therefore then be driven independently of the other cylinders 22, 24, 26 in the gearwheel train. As soon as the plate cylinder 23 is decoupled from the blanket cylinder 22, the accessory position between the plate cylinder 23 and blanket cylinder 22 is also opened, as a result of which the two cylinders are no longer in contact. The operation which is described by way of example for the printing unit 3 is then likewise performed on the other printing units 1 and 2 if there are no disruptions or error reports.

Furthermore, a plate clamping device 11 which is situated on the plate changer 17 can be seen in FIG. 4. The plate clamping device 11 is configured in such a way that the old printing plate 7 can be pushed in upward only in one direction, as a result of which the old printing plate 7 cannot slide back again. Undesired sliding back in the direction of the plate cylinder 23 is therefore reliably prevented. The plate clamping device 11 is formed of a clamping roller 11.1, a clamping face 11.2 and a guide track 11.3. During the conveying out of the old printing plate 7, the clamping roller 11.1 is pushed upward along the guide track 11.3. As a result of its weight or additional assistance in the form of a spring force, the roller 11.3 clamps the old printing plate 7 with respect to the clamping face 11.2, as a result of which sliding back is reliably prevented. As a result, the old printing plate 7 can only be moved upward.

If, however, there is a disruption in a printing unit, for example in the printing unit 3, the controller 32 of the printing press changes into a mode for eliminating that disruption and first of all brings the main drive 5 of the machine to a standstill. Subsequently, the disrupted printing unit 3 switches to "thrown off," that is to say the blanket cylinder 22 is set off from the plate cylinder 23, that is to say is displaced by $\Delta_Z$ of approximately 0.5 millimeter into positions shown by using dash-dotted lines (FIG. 3) through non-illustrated pneumatically actuated eccentrics. At the same time, the clutch 29 opens and therefore interrupts the force flow between the plate cylinder 23 and the main drive 5 in the printing unit 3.

The disruption can lie, for example, in the fact that the clamping rail of the plate clamping device 12 for the rear edge of the printing plate 7 has not opened, which has been detected by the sensor 28 and has been reported to the controller 32 of the machine by a corresponding signal. In this case, the plate cylinder 23 is moved by the drive motor 4 of its auxiliary drive into the position in which the screws of the clamping rail can be opened manually. This is carried out by the operator and the printing unit thus has its disruption eliminated.

Subsequently, the operator presses a button for running the drive, and the printing units which are not disrupted, for example 2 and 3, continue the ejection of the old printing plate 7, as described in the preceding text. During this, the motor 4 of the auxiliary drive rotates the coupled plate cylinder 23 in the printing unit which has just had its disruption eliminated, until the end of the plate 7 has reached the sensor 28.

The positioning movement of the plate cylinder takes place in the forward direction, while the blanket cylinder 22 is either at a standstill or rotates in the reverse direction. In this way, it is ensured that the loose rear edge of the plate 7 cannot come into contact anywhere in the printing unit and be bent in the process. After the plates are then unclamped in the printing units 2 and 3 which are not disrupted, the main drive 5 rotates into a position in which the printing units 1 and 2 are synchronous with respect to the position which the plate cylinder 23 in the printing unit 3, which has just had its disruption eliminated, assumes. There, the clutch 29 between the plate cylinder 23 and the main drive 5 is still open. In order now to eject the plate 7 in the printing unit 1, the plate cylinder 23 is then rotated backward by the drive motor 4 of its auxiliary drive. At the same time, the main drive 5 likewise rotates the machine and therefore also the blanket cylinder 22 in the printing unit 1 backward, but at a somewhat increased speed. A difference $\delta_y$ between the circumferential speed $V_{PL}$ of the plate cylinder 23 and the circumferential speed $V_{GZ}$ of the blanket cylinder 22 lies between 0.5 and 10% of the magnitude of the speed. In this way, it is ensured that the printing plate 7, the rear edge of which is released after all, does not bulge or bend as a result of accidental contact with the surface of the rubber blanket on the blanket cylinder 22, since the somewhat higher circumferential speed of the blanket cylinder 22 in this case exerts a tensile force on the plate 7 which is still clamped in after all with its front edge by the clamping rail 13.

If the plate 7 in the printing unit 1 is then pushed out into the plate changer 17, the drive 4 for the printing unit 3 which has just had its disruption eliminated also stops and the operator can remove the plate which has been pushed out. The operating staff can then place the new printing plate 6 attached laterally to the plate changer 17 in all of the printing units onto the register pins in the plate clamping device 13 for the front edge of the plate 6 or, in an alternative variant, the contact can be produced by automatic feeding of the plate.

Subsequently, in each case the new printing plates 6 can be pulled in synchronously in all of the printing units jointly. To this end, as described in the text above, all of the plate cylinders are separated from the other cylinders 22, 24, 26 in the gearwheel train by opening of the mechanical clutches 29, and also the accessory position between the plate cylinders 23 and the blanket cylinders 22 in the printing units 1 and 2 which are not disrupted is opened into the "thrown off" position. When the new printing plate 6 is in contact correctly in each case, the plate clamping device 13 at the front edge is closed and the control computer triggers the plate intake. In this case, all of the plate cylinders 23 in the printing units 1, 2 and 3 now rotate slowly forward driven by the motor 4 of their auxiliary drives because the new printing plates 6 are pressed onto their respective plate cylinder 23 by "ironing" rollers 15. After complete intake of the new printing plates 6, the rear edge of the printing plates is pushed into the plate clamping device 12 for the rear edge through the use of the pressure element 16, with the result that the plate clamping device 12 can close and the plate is locked in each case reliably at the rear edge. The coupling of the plate cylinders 23 into the mechanical gear train is then performed automatically by the control computer of the printing press 30. The plate changing operation is therefore then ended.

In the present exemplary embodiment, it has been described that the printing units 1 and 2, which are not disrupted, do not end their ejection of the old printing plate 7 in such a way that the plate cylinder in the disrupted printing unit decouples, and the other printing units do not continue their ejection in the coupled state until the disruption in the disrupted printing unit is eliminated manually. However, other sequences are also possible in this case. For instance, it can be expedient if, when a disruption occurs, for example also in the printing unit 3 again, first of all, all of the printing units are thrown off and moved to "thrown off" and are separated from the main drive 5 and/or the gear train of the machine through the clutches 29. All of the printing units which are not disrupted can then, for example, continue their ejection, by the plate cylinders 23 being moved backward by the motors 4 of their auxiliary drives. During this, the machine likewise rotates the blanket cylinders 22 backward, to be precise also again at a somewhat higher circumferential speed, in order to avoid bulging of the printing plates 7, as described in the above text, upon accidental contact with the blanket cylinder. It is only when all of the printing plates in the printing units 1 and 2 which are not disrupted are thus pushed into the respective plate changers 17, that both the main drive 5 and the motors 4 of the auxiliary drives stop, and the disrupted printing unit 3 subsequently has its disruption eliminated manually by the operator and, after its printing plate is removed, can perform the plate intake synchronously with the other printing units which are not disrupted.

As a further alternative, it is also possible to perform the plate changing operation completely with the intake of the new plates in the printing units which are not disrupted, before the manual disruption elimination takes place in the disrupted printing unit.

In all cases, however, when the plate cylinder 23 rotates backward in a printing unit with an unclamped rear edge, at the same time the blanket cylinder 22 is likewise rotated backward at a somewhat increased circumferential speed.

The invention claimed is:

1. A method for changing printing plates in rotary printing presses having a plurality of printing units, the method comprising the following steps:

providing each printing unit with a blanket cylinder, a plate cylinder associated with the blanket cylinder, and a dedicated drive for driving the plate cylinder independently of the associated blanket cylinder;

during a plate changing operation, at least in one operating mode for eliminating a disruption, rotating at least a blanket cylinder of a printing unit in which a disruption is or was present at a higher circumferential speed than an associated plate cylinder, while conveying one or more printing plates out of the printing unit;

decoupling the plate cylinder of the disrupted printing unit during the elimination of the disruption and rotating the plate cylinder into a reference position, while simultaneously conveying out the plates in the printing units not being disrupted; and subsequently, with the plate cylinder in the disrupted printing unit still being decoupled, rotating the plate cylinders of the other printing units into a position being synchronized with the reference position of the plate cylinder in the disrupted printing unit.

2. The method according to claim 1, which further comprises:

decoupling the plate cylinder of the disrupted printing unit during the elimination of the disruption;

moving the plate cylinder into a position in which a fastening device is accessible for clamping a plate on the plate cylinder; and subsequently manually releasing the fastening device.

3. The method according to claim 1, which further comprises subsequently conveying out a printing plate in the disrupted printing unit, while simultaneously backwardly rotating the blanket cylinders of all of the printing units, connected to a machine drive, at a higher circumferential speed.

4. The method according to claim 1, which further comprises:

feeding new plates into all of the printing units after conveying out the printing plates in the printing units not being disrupted;

eliminating the disruption in the disrupted printing unit;

conveying a plate out of the disrupted printing unit;

decoupling the plate cylinders of all of the printing units during conveying in of the new plates; and synchronously conveying the new plates into the respective printing units with the dedicated drives assigned to the plate cylinders rotating all of the plate cylinders at the same time.

5. A method for changing printing plates in rotary printing presses having a plurality of printing units, the method comprising the following steps:

providing each printing unit with a blanket cylinder, a plate cylinder associated with the blanket cylinder, and a dedicated drive for driving the plate cylinder independently of the associated blanket cylinder;

during a plate changing operation, at least in one operating mode for eliminating a disruption, moving a plurality of blanket cylinders being coupled mechanically to one another at the same time at a higher circumferential speed than associated plate cylinders, while conveying one or more printing plates out of the printing unit;

decoupling the plate cylinder of the disrupted printing unit during the elimination of the disruption and rotating the plate cylinder into a reference position, while simultaneously conveying out the plates in the printing units not being disrupted; and subsequently, with the plate cylinder in the disrupted printing unit still being decoupled, rotating the plate cylinders of the other printing units into a position being synchronized with the reference position of the plate cylinder in the disrupted printing unit.

6. The method according to claim 5, which further comprises:

decoupling the plate cylinder of the disrupted printing unit during the elimination of the disruption;

moving the plate cylinder into a position in which a fastening device is accessible for clamping a plate on the plate cylinder; and subsequently manually releasing the fastening device.

7. The method according to claim 5, which further comprises subsequently conveying out a printing plate in the disrupted printing unit, while simultaneously backwardly rotating the blanket cylinders of all of the printing units, connected to a machine drive, at a higher circumferential speed.

8. The method according to claim 5, which further comprises:

feeding new plates into all of the printing units after conveying out the printing plates in the printing units not being disrupted;

eliminating the disruption in the disrupted printing unit;

conveying a plate out of the disrupted printing unit;

decoupling the plate cylinders of all of the printing units during conveying in of the new plates; and synchronously conveying the new plates into the respective printing units with the dedicated drives assigned to the plate cylinders rotating all of the plate cylinders at the same time.

9. A method for changing printing plates in rotary printing presses having a plurality of printing units, the method comprising the following steps:

providing each printing unit with a blanket cylinder, a plate cylinder associated with the blanket cylinder, and a dedicated drive for driving the plate cylinder independently of the associated blanket cylinder;

during a plate changing operation, at least in one operating mode being a disruption, moving a respective blanket cylinder at a higher circumferential speed than an associated plate cylinder, while conveying one or more printing plates out of the printing unit;

continuing conveying the plates out in the printing units not being disrupted, after an occurrence of the disruption;

subsequently eliminating the disruption in the disrupted printing unit and conveying out a plate there;

subsequently performing plate intake synchronously and/or at the same time for all of the printing units;

decoupling the plate cylinder of the disrupted printing unit during the elimination of the disruption and rotating the plate cylinder into a reference position, while simultaneously conveying out the plates in the printing units not being disrupted; and subsequently, with the plate cylinder in the disrupted printing unit still being decoupled, rotating the plate cylinders of the other printing units into a position being synchronized with the reference position of the plate cylinder in the disrupted printing unit.

10. The method according to claim 9, which further comprises:

decoupling the plate cylinder of the disrupted printing unit during the elimination of the disruption;

moving the plate cylinder into a position in which a fastening device is accessible for clamping a plate on the plate cylinder; and subsequently manually releasing the fastening device.

11. The method according to claim 9, which further comprises subsequently conveying out a printing plate in the disrupted printing unit, while simultaneously backwardly rotating the blanket cylinders of all of the printing units, connected to a machine drive, at a higher circumferential speed.

12. The method according to claim 9, which further comprises:

feeding new plates into all of the printing units after conveying out the printing plates in the printing units not being disrupted;

eliminating the disruption in the disrupted printing unit;

conveying a plate out of the disrupted printing unit;

decoupling the plate cylinders of all of the printing units during conveying in of the new plates; and synchronously conveying the new plates into the respective printing units with the dedicated drives assigned to the plate cylinders rotating all of the plate cylinders at the same time.

13. A method for changing printing plates in rotary printing presses having a plurality of printing units, the method comprising the following steps:

providing each printing unit with a blanket cylinder, a plate cylinder associated with the blanket cylinder, and a dedicated drive for driving the plate cylinder independently of the associated blanket cylinder;

during a plate changing operation, at least in one operating mode being a disruption, moving a respective blanket cylinder at a higher circumferential speed than an associated plate cylinder, while conveying one or more printing plates out of the printing unit;

initially completely terminating the plate changing operation in the printing units not being disrupted, after the occurrence of the disruption;

conveying new printing plates into the printing units and fastening the new printing plates on the plate cylinders;

subsequently eliminating the disruption in the disrupted printing unit;

decoupling the plate cylinder of the disrupted printing unit during the elimination of the disruption and rotating the plate cylinder into a reference position, while simultaneously conveying out the plates in the printing units not being disrupted; and subsequently, with the plate cylinder in the disrupted printing unit still being decoupled, rotating the plate cylinders of the other printing units into a position being synchronized with the reference position of the plate cylinder in the disrupted printing unit.

14. The method according to claim 13, which further comprises:

decoupling the plate cylinder of the disrupted printing unit during the elimination of the disruption;

moving the plate cylinder into a position in which a fastening device is accessible for clamping a plate on the plate cylinder; and subsequently manually releasing the fastening device.

15. The method according to claim 13, which further comprises subsequently conveying out a printing plate in the disrupted printing unit, while simultaneously backwardly rotating the blanket cylinders of all of the printing units, connected to a machine drive, at a higher circumferential speed.

16. The method according to claim 13, which further comprises:

feeding new plates into all of the printing units after conveying out the printing plates in the printing units not being disrupted;

eliminating the disruption in the disrupted printing unit;

conveying a plate out of the disrupted printing unit;

decoupling the plate cylinders of all of the printing units during conveying in of the new plates; and synchronously conveying the new plates into the respective printing units with the dedicated drives assigned to the plate cylinders rotating all of the plate cylinders at the same time.

* * * * *